US007674127B2

(12) United States Patent
Lichtinger

(10) Patent No.: US 7,674,127 B2
(45) Date of Patent: Mar. 9, 2010

(54) ELECTRICAL CONTACT-MAKING ELEMENT

(75) Inventor: Bernhard Lichtinger, Sünching (DE)

(73) Assignee: VDO Automotive AG, Munich (DE)

( * ) Notice: Subject to any disclaimer, the term of this patent is extended or adjusted under 35 U.S.C. 154(b) by 0 days.

(21) Appl. No.: 11/996,554

(22) PCT Filed: Jun. 20, 2006

(86) PCT No.: PCT/EP2006/063339

§ 371 (c)(1),
(2), (4) Date: Jan. 23, 2008

(87) PCT Pub. No.: WO2007/014797

PCT Pub. Date: Feb. 8, 2007

(65) Prior Publication Data

US 2008/0200047 A1 Aug. 21, 2008

(30) Foreign Application Priority Data

Aug. 2, 2005 (DE) ..... 10 2005 036 296

(51) Int. Cl.
*H01R 31/08* (2006.01)

(52) U.S. Cl. ..... 439/511; 439/943

(58) Field of Classification Search ..... 439/74, 439/189, 507, 509, 511, 943
See application file for complete search history.

(56) References Cited

U.S. PATENT DOCUMENTS

| | | | | |
|---|---|---|---|---|
| 5,062,805 | A * | 11/1991 | Liu et al. | 439/404 |
| 5,257,941 | A * | 11/1993 | Lwee et al. | 439/65 |
| 5,387,111 | A * | 2/1995 | DeSantis et al. | 439/65 |
| 6,524,129 | B2 * | 2/2003 | Cote et al. | 439/511 |
| 6,746,275 | B2 * | 6/2004 | Yamakawa et al. | 439/507 |
| 6,780,064 | B2 * | 8/2004 | Abel et al. | 439/717 |
| 6,923,661 | B1 * | 8/2005 | Bogiel et al. | 439/78 |

* cited by examiner

*Primary Examiner*—Thanh-Tam T Le
(74) *Attorney, Agent, or Firm*—Laurence A. Greenberg; Werner H. Stemer; Ralph E. Locher

(57) ABSTRACT

An electrical contact-making element for electrical carrier components in an electronic housing is particularly suited for automotive applications. The electrical contact-making element is in the form of a U-shaped plug pin having a base limb and two side limbs. There is provided a robust, reliable electrical contact connection between a plurality of electrical carrier components, such as printed circuit boards, for example, which ensures secure contact is made even in the case of external influences such as vibrations, for example, and can be fitted, by way of a simple press-in mechanism, at the end of the fitting process.

10 Claims, 5 Drawing Sheets

ELECTRICAL CONTACT-MAKING ELEMENT

BACKGROUND OF THE INVENTION

Field of the Invention

To this end, DE 100 61 866 A1 discloses an electrical arrangement which can be fitted onto a roof of a motor vehicle, with which a flexible printed circuit board is welded to a housing of a light-emitting diode using the effect of heat and in which a flat flexible cable for the external terminal is electrically connected to the printed circuit board by means of clamping or welding.

DE 197 50 224 A1 discloses a plug for producing a detachable electrical connection between a flat flexible cable and a printed circuit board. In this process, contact between the cable conductors and the conductor surfaces of the printed circuit board is made by a means generating a contact pressure. The plug includes an upper and a lower plug part, which consist of insulating material and form a clamping limb, between which both the flat flexible cable, for the purpose of strain relief, and also the conductor cores of the flat flexible cable and metallized regions of the printed circuit boards, for the purpose of contact-making, can be clamped. In this process, the upper plug part cooperates with first recesses of the printed circuit board for the purpose of the clear separation of adjacent conductors of the flat flexible cable and the lower plug part cooperates with two recesses of the same for the purpose of locking the inserted plug as well as the flat flexible cable onto the printed circuit board.

The disadvantages involved in using flexible elements, such as for instance flat flexible cables for the contact connection of two printed circuit boards for instance, consist in a maximum current transmission mostly only being possible for signal contacts and the positioning on the printed circuit board mostly having a negative effect on the electromagnetic compatibility. In addition, in particular in electronic housings for the automotive sector, high demands are placed on the vibration resistance of the freely oscillating cable, which can also be damaged or destroyed during the fitting process. In particular, longer cables exhibit high losses for critical conductors and have a negative effect on the electromagnetic compatibility. With the use of plug connections, it is particularly disadvantageous that the plug connection requires a housing, which in turn results in an increased space requirement.

Alternatively, DE 42 08 765 A1 discloses an operating box, which comprises one or a number of circuit boards separated from one another by means of insulation having printed circuits made out of conductive material attached on one or both sides, onto which components are plugged and soldered, with the printed circuits being electrically conductively connected by means of pins to both sides of a circuit board or the printed circuits. The disadvantage here is however that the pins enabling the electrical contact have to be suitably fitted into a connector fastener, which results in an assembly problem as a result of the plurality of pins and the mechanical overdetermination associated therewith.

BRIEF SUMMARY OF THE INVENTION

Based on this, the object underlying the present invention is to create an electrical contact-making element for printed circuit boards such that both a transmission of signal and also of power contacts is enabled which is stable with respect to other influences, such as vibrations for instance and herewith still provides for a simple fitting process.

This object is achieved by an electrical contact-making element having the features of claim 1. Advantageous embodiments and developments, which can be used individually or in combination with one another, are the subject matter of the dependent claims.

The electrical contact-making element according to the invention is characterized in that the electrical contact-making is carried out by way of at least one u-shaped plug pin. The u-shaped embodiment having two side limbs which run in parallel with one another and a base limb connecting the side limbs to one another allows an electrical contact connection, which can be easily pressed in, between two printed circuit boards, which are already equipped with electrical components and are screwed into the housing, characterized in that the electrical contact-making element, in the subsequent fitting step, is inserted into the holes provided in the housing upper part and into the holes provided in the printed circuit board.

The plug pin preferably comprises different limb lengths, so that printed circuit boards which are arranged in particular one above the other can be easily contacted without herefor having to design deep recesses in the housing lower part.

It is preferred if the plug pins comprise insertion shoulders so that a uniform insertion depth is achieved during the fitting process of the plug pin, the deviations of this positioning can be determined immediately, as a result of which a secure and stable contact connection is ensured.

The plug pin according to the invention advantageously has a spring system. This characteristic results in a more secure electrical contact being ensured even in the event of significant vibrations. In addition, an individual adaptability to unusual printed circuit board structures with electrical contact-making which is difficult to access is enabled by means of the spring embodiment.

The plug pin according to the invention preferably comprises a material composition made of copper/tin or copper/silver or copper/gold, with other electrically conductive material compositions also being conceivable. The selection of the material composition can be made as a function of the load to be expected in respect of the current flow rate.

It is advantageous if the plug pins are arranged in a stabilizing spacer. The spacer is used as a guide element when pressing the plug pins into the holes provided herefor in the printed circuit boards and/or in the housing upper part and as a stabilizer in the plugged-in state, so that the plug pins remain in a fixed position.

It is also preferable for the contact-making of the printed circuit boards to be carried out in a space-saving fashion by means of the plug pin according to the invention, in other words, less space has to be factored in for the electrical contact-making by means of the plug pins on the printed circuit boards to be contacted in each instance, and the printed circuit board can thus be used almost completely to accommodate electrical components.

It is also preferred if the plug pins are fitted after the printed circuit boards have been fitted into the housing by way of a simple press-in mechanism. There is thus no need for complicated soldering or welding processes.

It is preferred if the printed circuit boards are arranged one above the other so that a plurality of electrical components can be positioned in as space-saving a fashion as possible and the electrical contact-making of the printed circuit boards is carried out easily by correspondingly lengthening the limbs of the u-shaped plug pins.

The plug pins are preferably manufactured from a corrosion-resistant material, since in particular the base limbs are arranged in a space, which substances causing corrosion are able to reach, even if a protective cover is applied to the housing after the plug pins have been pressed in again.

The present invention firstly advantageously achieves a stable, reliable electrical contact between a number of carrier components, such as for instance printed circuit boards, for example, which ensures secure contact is made even in the case of external influences such as vibrations, for example, and can be fitted, by means of a simple press-in mechanism, at the end of the fitting process. It is particularly suited to applications in the automotive sector.

Further advantages and embodiments of the invention are described in more detail below with reference to exemplary embodiments as well as with reference to the figures, in which;

DESCRIPTION OF THE INVENTION

Figure 1:
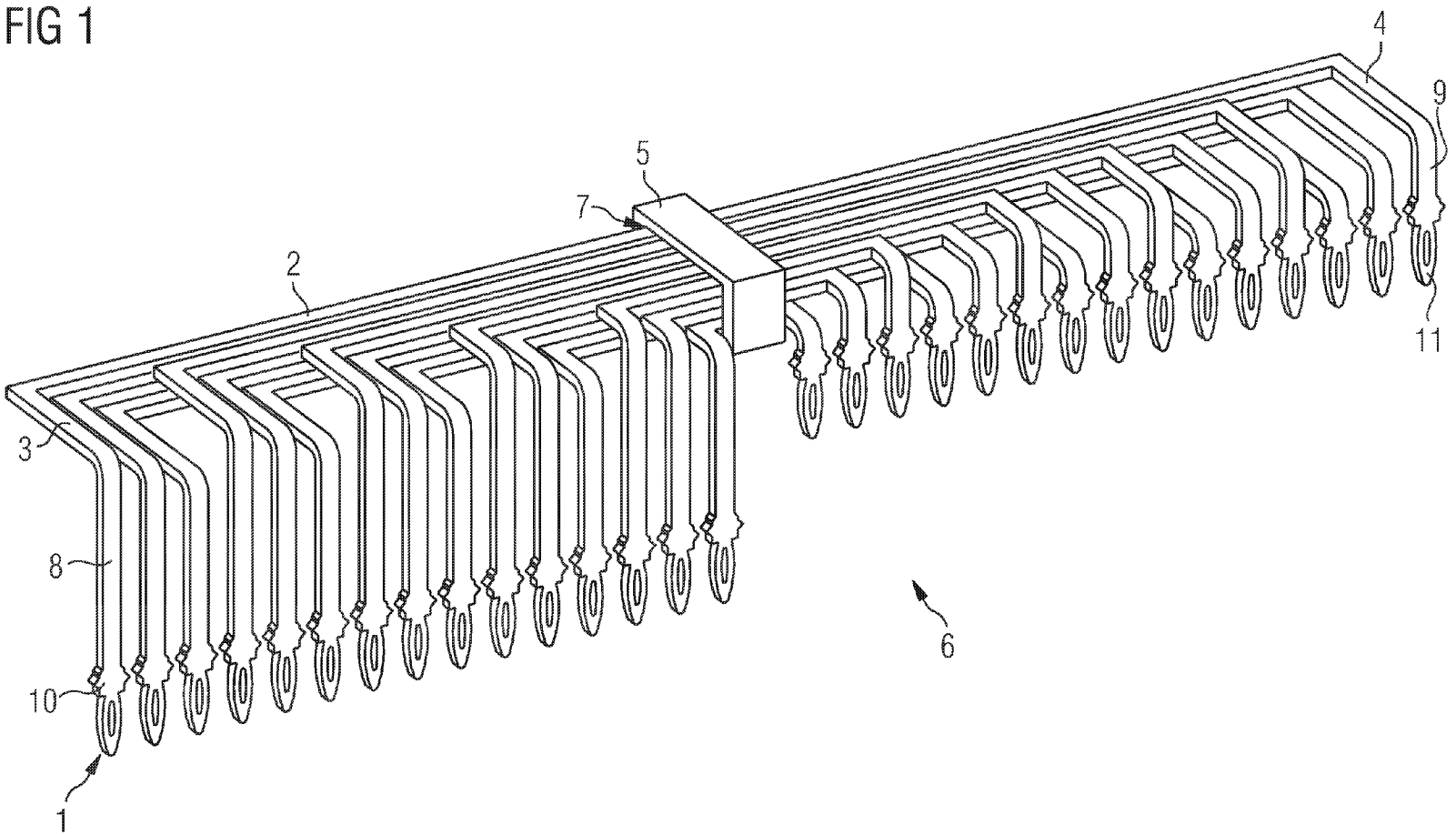
FIG. 1 shows a schematic illustration of a perspective view of a first exemplary embodiment of an electrical contact-making element according to the invention

FIG. 1 shows a perspective view of a first exemplary embodiment of an electrical contact-making element according to the invention. The electrical contact-making element is embodied as a u-shaped plug pin 1. The u-shaped plug pin 1 has a base limb 2 as well as two side limbs 3, 4 which run in parallel to one another. A stabilizing spacer 5 positions the individual plug pins 1 so that a plug comb 6 results overall. The spacer 5 has a number of punch-through boreholes 7 arranged next to one another and below one another, preferably equally distanced from one another, in which the base limbs 2 of the plug pin 1 are mounted. The spacer 5 preferably has three rows arranged one above the other having five boreholes in each instance, with each other arrangement also being conceivable for the punch-through boreholes 7. The base limbs 2 preferably have different lengths. Three plug pins 1 arranged one below the other in each instance form a group, with the plug pins 1 mounted in the outer rows each having the shortest and/or longest base limb 2. The side limbs 3, 4 are preferably bent downwards to the height of the spacer 5 by approximately 90°. The bent side limbs 8, 9 end in insertion shoulders 10, which are formed wider than the bent side limbs 8,9 so that they allow a defined insertion depth when subsequently fitted to the electronic housing. The insertion shoulders 10 open out into arrow-shaped end regions 11, which facilitate the positioning of the individual plug pins when being pressed into the electronic housing and are used as pressed-in means.

Both the base limb 2 and also the side limbs 3, 4 and/or the bent side limbs 8, 9 preferably have different lengths, so that a plurality of contacts is possible as a result of the different embodiments of the plug pins 1. The plug pins 1 preferably have a spring. This characteristic facilitates both the pressing-in process and attenuates possible vibrations. Copper/tin, copper/silver or copper/gold are preferably selected as the material composition for the plug pins 1, with each other electrically conductive material also being conceivable. Small holes are provided for the contact-making of the respective electrical carrier components, such as for instance printed circuit boards, into which holes the arrow-shaped end regions 11 of the side limbs 3, 4 of the plug pins 1 are inserted. This contact-making of the individual printed circuit boards saves space, since the remaining installation space on the carrier components is available for electrical components. The plug pins are preferably produced from a temperature-stable and corrosion-resistant material, since they are arranged in a space, which substances causing corrosion can reach.

Figure 2:
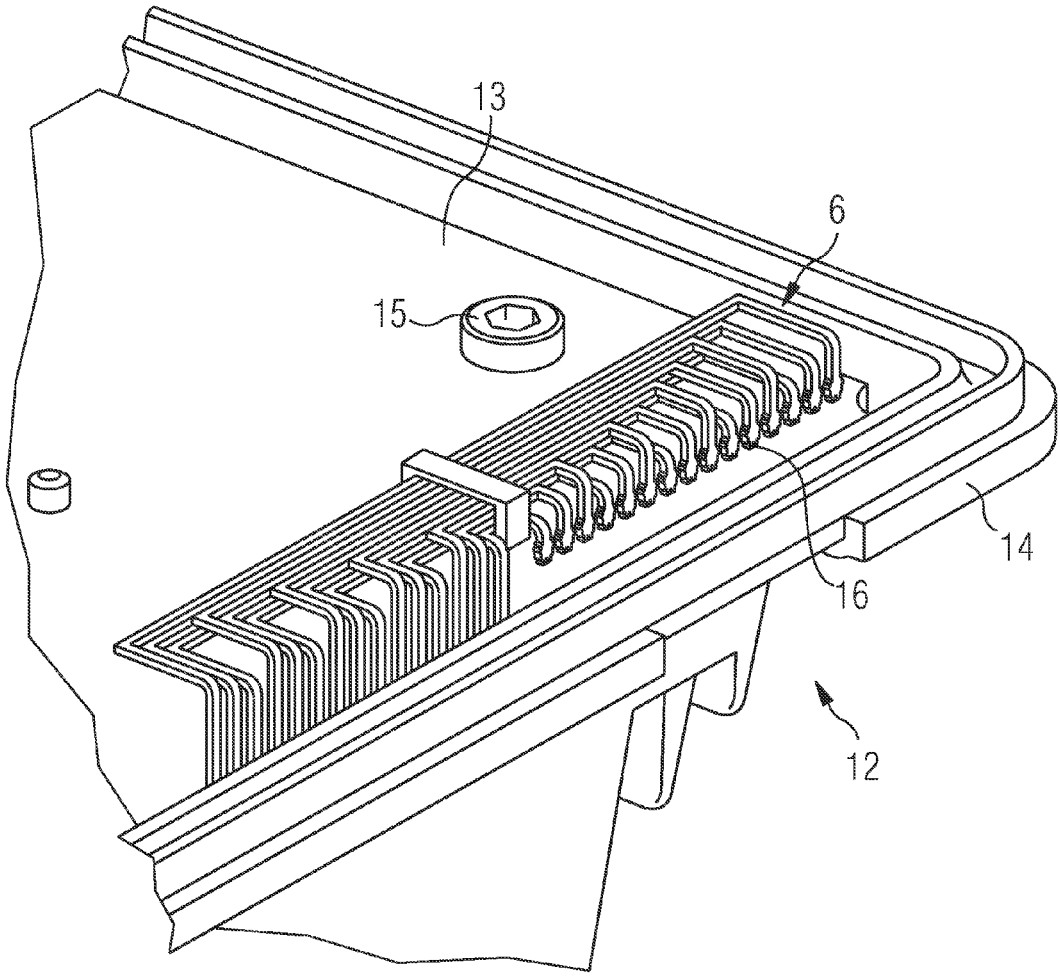
FIG. 2 shows a schematic illustration of a perspective view of the electrical contact-making element as claimed in FIG. 1 after it has been fitted onto the electronic housing.

FIG. 2 shows a perspective view of the electrical contact-making element according to FIG. 1 after being pressed into the electronic housing 12. After fitting the housing part 13 to the housing part 14 by means of fastening means 15, such as screws for instance, the plug comb 6 is inserted into the openings 16 provided in the housing part 13. The plug comb 6 thus fits outside the electronic housing 12 on the housing part 13. The insertion depth is determined in each instance by the insertion shoulders 10 of the plug pins 1.

Figure 3:
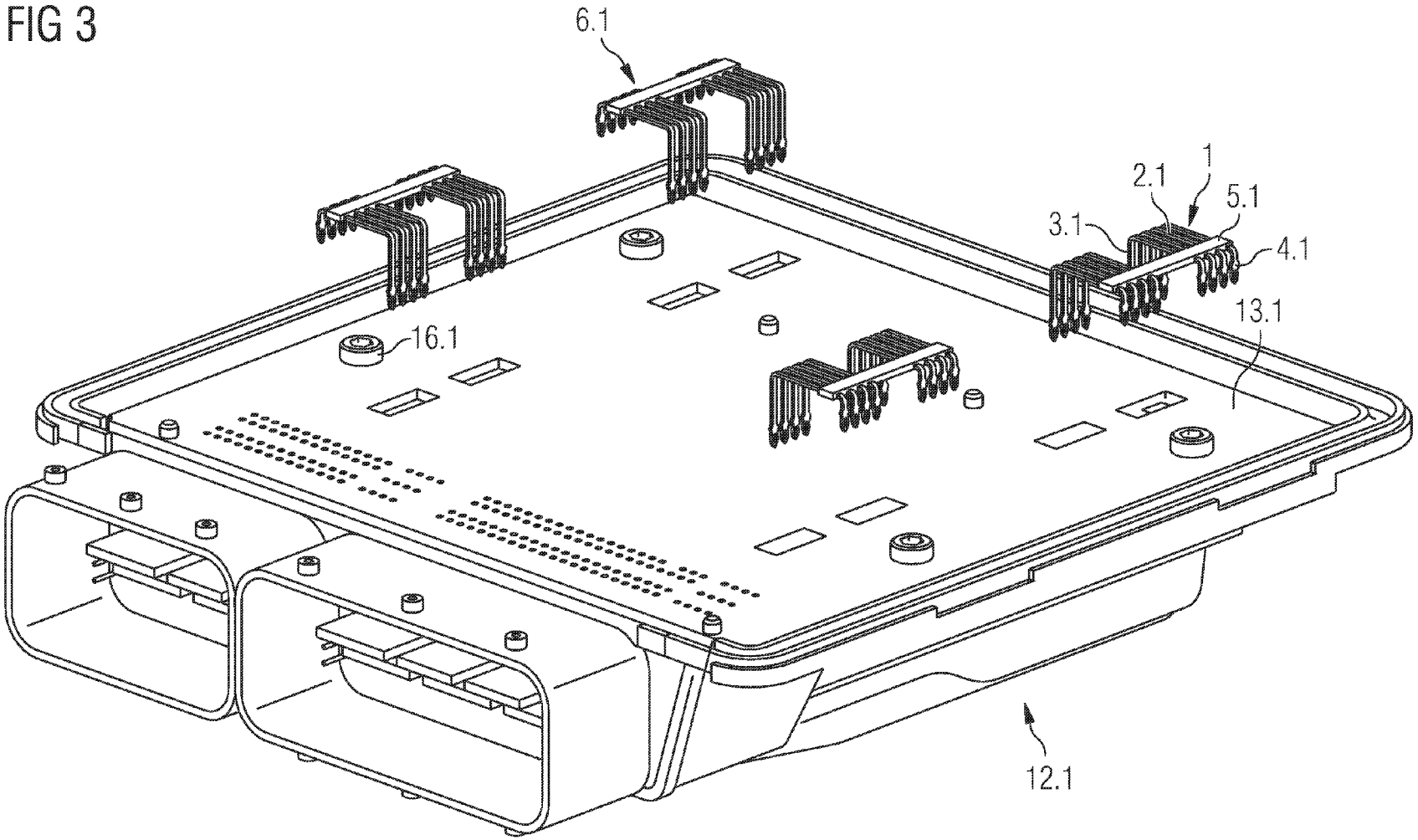
FIG. 3 shows a schematic illustration of a perspective view of a second exemplary embodiment of the electrical contact-making element according to the invention prior to the fitting process

FIG. 3 shows a perspective view of a second exemplary embodiment of the electrical contact-making element according to the invention prior to the fitting process. In this process, the u-shaped plug pins 1.1. are positioned in a preferably single-row spacer 5.1. The plug pins 1.1. positioned in a spacer 5.1 in each instance preferably have the same base limb lengths 2.1. The side limbs 3.1 and 4.1. running in parallel to each other preferably have different limb lengths. The positioning of the spacer 5.1 on the base limbs 2.1 of the plug pins 1.1 can be adjusted in a variable fashion. The plug comb 6.1 is inserted in each instance into the openings 16.1 of the housing part 13.1 provided herefor from above.

Figure 4:
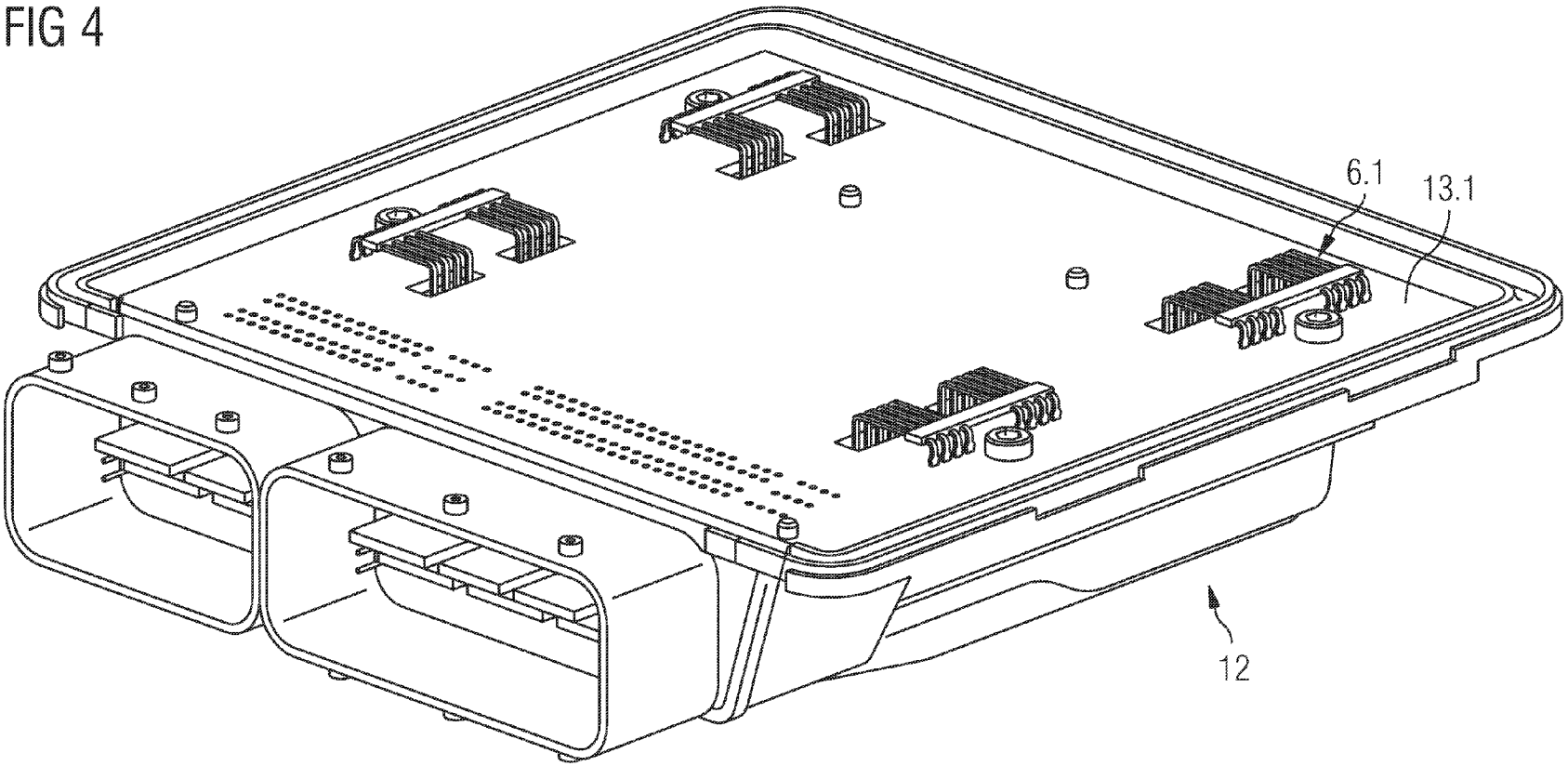
FIG. 4 shows a schematic illustration of a perspective view of the electrical contact-making element according to FIG. 3 after being fitted to the electronic housing and FIG. 5 shows a schematic illustration of a perspective view of the electrical contact-making element having contact connections on different printed circuit board planes.

FIG. 4 shows a perspective view of the electrical contact-making element according to FIG. 3 following the press-in process in the electronic housing.

Figure 5:
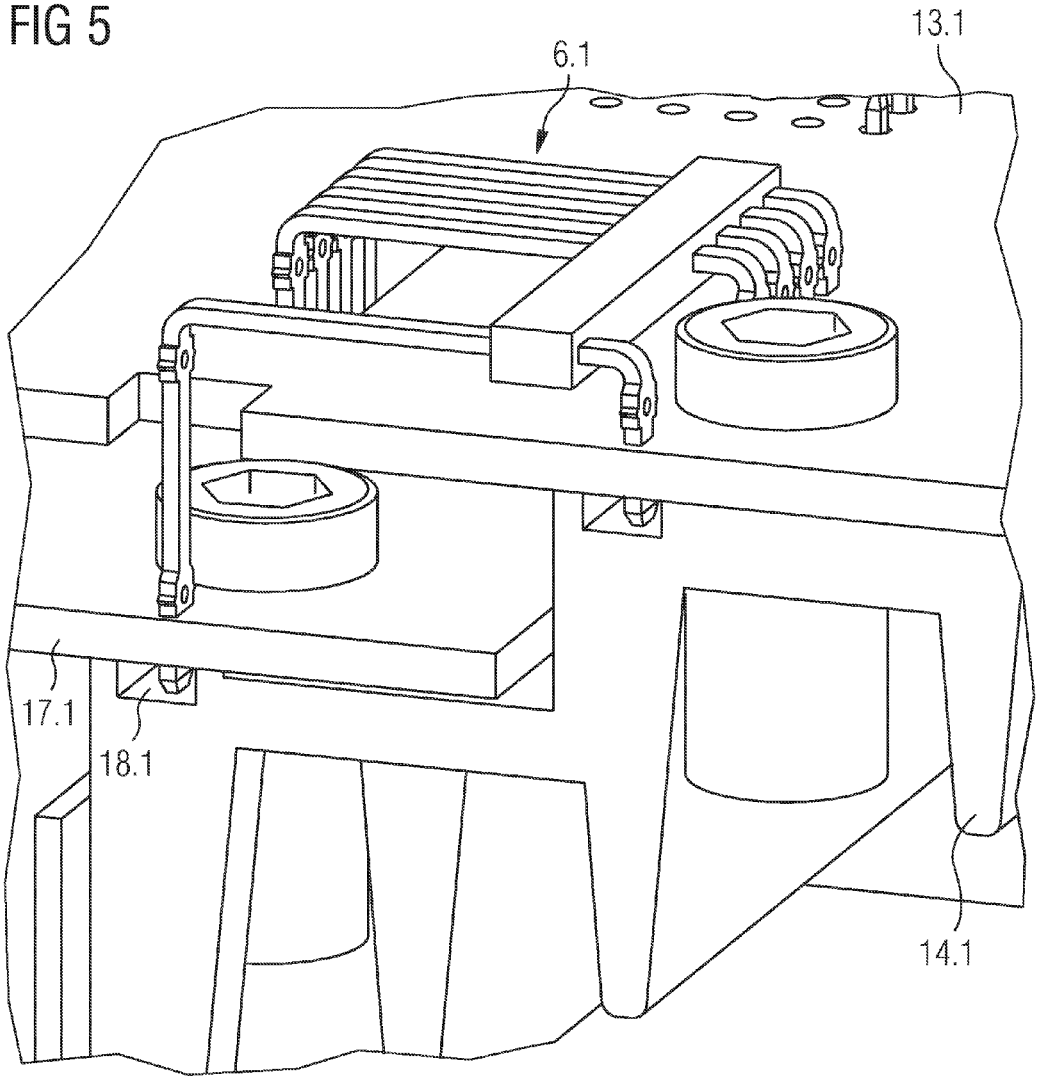

FIG. 5 shows a perspective view of the electrical contact-making element according to FIGS. 3 and 4 with contact connections being made on the different printed circuit board planes. In this way, the housing part 13.1 is used as a printed circuit board of the first plane. This printed circuit board 13.1 is electrically contacted by the side limbs 4.1 of the plug comb 6.1. A further printed circuit board 17.1 is located below this printed circuit board 13.1, said printed circuit board 17.1 being electrically contacted by a side limb 3.1 which is formed longer than side limb 4.1. Recesses 18.1 are arranged in this housing part 14.1 in the region of the arrow-shaped end regions 11.1 of the plug pins 1.1 pressed into the electronics housing 12.1, said recesses 18.1 preferably being embodied as u-shaped pockets and thus replacing the pressing-in tool required here when pressing-in the plug pins 1.1. The arrow-shaped end regions 11.1 thus completely pierce the printed circuit boards 13.1 and/or 17.1.

The present invention firstly advantageously produces a stable, reliable electrical contact connection between a number of electrical carrier components, such as for instance printed circuit boards, which ensures secure contact is made even in the case of external influences such as vibrations, for instance, and can be fitted, by means of a simple press-in mechanism, at the end of the fitting process. It is particularly suited to applications in the automotive sector.

The invention claimed is:

1. An electrical contact-making element for electrical carrier components in an electronic housing, comprising:

a plurality of U-shaped plug pins forming an electrical contact connection, each of said U-shaped plug pins having a base limb formed with a first end and a second end, a first side limb extending from said first end of said base limb, and a second side limb extending from said second end of said base limb, and wherein said base limbs are formed with a plurality of mutually different base limb lengths;

a stabilizing spacer holding said plug pins, said stabilizing spacer having a plurality of bores formed therein next to one another and below one another, with said different-length base limbs of said plug pins projecting through said bores to form a plug comb;

wherein said first side limb has a length and said second side limb has a length that is different from said length of said first side limb.

2. The contact-making element according to claim 1, wherein said plug pins are constructed as a spring system.

3. The contact-making element according to claim 1, wherein each of said plug pins is formed of a material having a material composition selected from the group consisting of copper/tin, copper/silver, or copper/gold.

4. The contact-making element according to claim 1, wherein the contact connection of the electrical carrier components is configured to minimize a space occupied thereby.

5. The contact-making element according to claim 1, wherein said plug pins are configured to be fitted in the housing by way of a simple press-in mechanism after the carrier components have been fitted.

6. The contact-making element according to claim 1, wherein the electrical carrier components are disposed on top of one another.

7. The contact-making element according to claim 1, wherein said plug pins are produced from a corrosion-resistant material.

8. The contact-making element according to claim 1, wherein said plurality of U-shaped plug pins and said stabilizing spacer are configured for installation in an automobile.

9. The contact-making element according to claim 1, wherein said stabilizing spacer overlies only said base limbs of said plug pins.

10. The contact-making element according to claim 1, in combination with the electronic housing, wherein:

the electronic housing includes a plurality of printed circuit boards disposed at different levels inside the electronic housing; and the contact-making element is disposed outside the electronic housing and extends through the electronic housing to electrically contact the plurality of printed circuit boards.

* * * * *